US005106012A

United States Patent [19]

Hyzak et al.

[11] Patent Number: 5,106,012

[45] Date of Patent: Apr. 21, 1992

[54] DUAL-ALLOY DISK SYSTEM

[75] Inventors: John M. Hyzak, Shrewsbury; Timothy E. Howson, Westboro; Wilford H. Couts, Jr., Northboro; Steven H. Reichman, Worcester; Hugo E. Delgado, Arlington, all of Mass.; Daniel D. Kruger, Cincinnati, Ohio; Michael E. Sauby, Cincinnati, Ohio; Sulekh C. Jain, Cincinnati, Ohio; Bruce P. Bardes, Montgomery, Ohio; Richard G. Menzies, Wyoming, Ohio; Swami Ganesh, West Chester, Ohio

[73] Assignee: Wyman-Gordon Company, Worcester, Mass.

[21] Appl. No.: 225,907

[22] Filed: Jul. 29, 1988

Related U.S. Application Data

[63] Continuation of Ser. No. 377,925, Jul. 10, 1989, which is a continuation of PCT/US89/03292. Jul. 28, 1989.

[51] Int. Cl.[5] ..... B23K 20/02; B23P 15/04; B21K 1/28; B21K 3/00

[52] U.S. Cl. ..... 228/265; 228/125; 228/193; 228/237; 228/243; 416/241 R; 29/889; 29/889.2; 72/360; 72/700

[58] Field of Search ..... 228/125, 159, 160, 265, 228/237, 243, 193, 112, 115; 29/DIG. 31, 156.8 R, 889, 889.2; 419/26, 28; 416/241 R, 223 A; 72/360, 700

[56] References Cited

U.S. PATENT DOCUMENTS

| | | | |
|---|---|---|---|
| 3,046,640 | 7/1962 | Singleton, Jr. | 228/235 |
| 3,098,022 | 7/1963 | Karnie | 228/265 |
| 3,106,013 | 10/1963 | Rozmus | 228/265 |
| 3,219,748 | 11/1965 | Miller | 228/115 |
| 3,225,437 | 12/1965 | Stohr et al. | 228/125 |
| 3,259,969 | 7/1966 | Tessmann | 228/125 |
| 3,436,804 | 4/1969 | Broverman | 228/243 |
| 3,950,841 | 4/1976 | Conn | 228/125 |
| 4,043,498 | 8/1977 | Conn, Jr. | 228/193 |
| 4,074,559 | 2/1978 | Beane et al. | 29/156.8 B |
| 4,094,453 | 6/1978 | Cook et al. | 228/243 |
| 4,207,762 | 6/1980 | Kelly, Jr. | 72/360 |
| 4,333,671 | 6/1982 | Holko | 228/112 |
| 4,470,537 | 9/1984 | Diem et al. | 228/193 |
| 4,479,293 | 10/1984 | Miller et al. | 416/241 R |
| 4,529,452 | 7/1985 | Walker et al. | 148/11.5 Q |
| 4,566,625 | 1/1986 | Moe | 228/265 |
| 4,581,300 | 4/1986 | Hoppin, III et al. | 416/223 A |
| 4,673,124 | 6/1987 | Conolly | 228/170 |
| 4,750,946 | 6/1988 | Jahnke et al. | 148/11.5 N |
| 4,843,856 | 7/1989 | Bhowal et al. | 72/700 |

FOREIGN PATENT DOCUMENTS

| | | | |
|---|---|---|---|
| 709573 | 8/1941 | Fed. Rep. of Germany | 72/360 |
| 1156793 | 5/1985 | U.S.S.R. | 72/360 |
| 1328053 | 8/1987 | U.S.S.R. | 72/360 |

OTHER PUBLICATIONS

Welding Journal, "New Forge Welding of Aluminum and Magnesium Alloys", vol. 37, pp. 348-358, Apr. 1958.

*Primary Examiner*—Sam Heinrich

*Attorney, Agent, or Firm*—Blodgett & Blodgett

[57] ABSTRACT

Two pieces of metal are bonded together at a surface by placing the two pieces into contact at the surface and forging the two pieces in a die which causes substantial displacement of the metal originally at the surface in a direction parallel to and outwardly from the edges of the surface. In this way, many of the defects which are potentially present at the original surface are displaced with moving metal away from the original contact between the two pieces of metal into sacrificial ribs and the remaining defects are exposed to significant strain. A portion of the displaced metal which contains many of the defects and which forms the sacrificial ribs is removed from the resulting bonded work piece as the sacrificial ribs are removed from the work piece. The result is a bond with superior properties and with a bond surface which can be located very precisely. This system is particularly appropriate for forming dual-alloy high-pressure turbine disks for gas turbines in which an annular peripheral ring of a second super-alloy is bonded to a central core of a first super-alloy. The system is particularly effective if, prior to forging, surfaces to be bonded are closely shape-conforming, are very clean, and are diffusion-bonded using hot isostatic pressing while the surfaces are gas-free. The sacrificial ribs are formed by vents in the impression of the forging dies. The vents are adjacent to the outer edges of the bond surface. The system may be accomplished by using one or more strikes of the same dies, or may include multiple strikes in which only one side of the bond is vented during each strike.

46 Claims, 7 Drawing Sheets

DUAL-ALLOY DISK SYSTEM

This is a continuing application of co-pending application, Ser. No. 07/377,925, filed on Jul. 10, 1989, and is a continuing application of co-pending International Application PCT/US89/03292, filed on Jul. 28, 1989 and which application designated the United States of America.

BACKGROUND OF THE INVENTION

It is generally the case that metallic articles are called upon to have a combination of properties, and often the property requirements vary from one portion of the article to another. In some cases a single material can satisfy the various property demands throughout the article. In other cases, however, it is not possible to achieve all material requirements in an article with a single material. In such cases it is known to use composite articles in which one portion of the article is fabricated from one material and a second portion is fabricated from another material and the various materials are selected on the basis of the properties required for the various portions of the article.

Occasionally, however, the use of composite articles involves serious practical problems. For example, in a gas turbine engine the disks which support the blades rotate at a high speed in a relatively elevated temperature environment. The temperatures encountered by the disk at its outer or rim portion are elevated, perhaps on the order of 1500° F. whereas in the inner bore portion which surrounds the shaft upon which the disk is mounted, the temperature will typically be much lower, less than 1000° F. Typically, in operation, a disk may be limited by the creep properties of the material in the high temperature rim area and by the tensile properties of the material in the lower temperature bore region. Since the stresses encountered by the disk are in large measure the result of its rotation, merely to add more material to the disk in areas where inadequate properties are encountered is not generally a satisfactory solution, since the addition of more material increases the stresses in other areas of the disk. There have been proposals to make the rim and bore portions of the disk from different materials and to bond these different materials together. This is not an attractive proposition, largely as a result of the difficulties encountered in bonding materials together in such a fashion as to reliably resist high stresses.

Accordingly, it is an object of the invention to provide a metallic article incorporating two alloy compositions and, therefore, having properties which vary from one portion of the article to another.

It is a further object of the invention to provide a metallic article incorporating two alloy compositions in which one portion of the article has the properties of one alloy and another portion of the article has the properties of the other alloy.

Another object of the invention is to describe a gas turbine disk having optimum tensile properties in its bore region and optimum creep properties in its rim region.

Yet another object of the invention is to describe a method of producing the previously described articles.

With the foregoing and other objects in view, which will appear as the description proceeds, the invention resides in the combination and arrangement of steps and parts and the details of the composition hereinafter described and claimed, it being understood that changes in the precise embodiment of the invention herein disclosed may be made within the scope of what is claimed without departing from the spirit of the invention.

SUMMARY OF THE INVENTION

As a general matter, the present invention can be used in two modes. The first mode, which shall be called forge bonding, involves the application of the present forging method to pieces of metal which are simply in physical contact or have been bonded together in only a limited way such as tack welding, or encapsulation welding. In this mode, the forge bonding provides the primary means by which the two pieces of metal become bonded In the second mode, which shall be called forge enhanced bonding, the two pieces of metal are bonded by other means prior to the application of the forging technique of this invention. In a situation which is particularly appropriate for the application of the second mode of this invention, the two pieces of metal are nickle-based super-alloys formed from fine-grained powder metal, and, prior to forge enhanced bonding, have been diffusion-bonded together using the method of hot isostatic pressing. When practical, the forging is accomplished under conditions which allow superplastic flow.

DESCRIPTION OF THE PREFERRED EMBODIMENT

Figure 1:
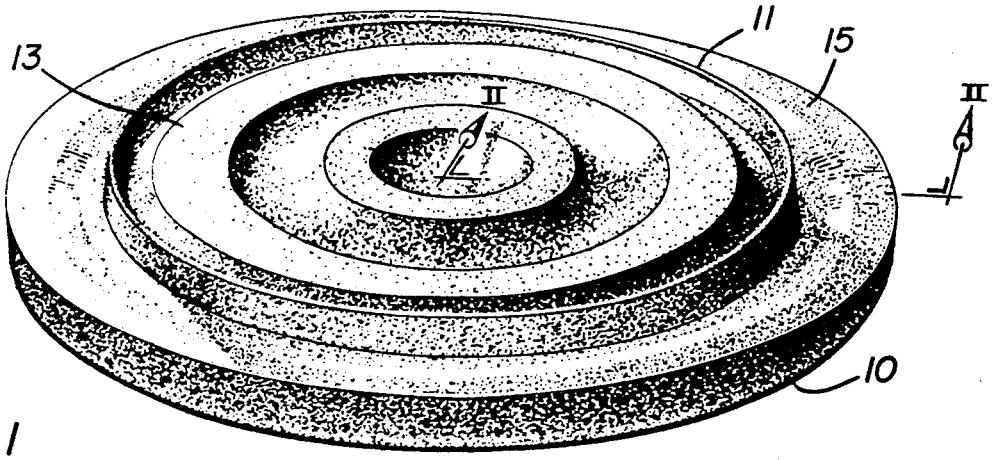
FIG. 1 is a turbine disk workpiece incorporating the principles of the present invention.

FIG. 1 shows a graphic representation of a forging workpiece which will be formed into a gas turbine disk after further processing. The workpiece 10 is shown to still bear the sacrificial rib 11 which is positioned adjacent the bond between the bore or plug 13 and the rim 15.

Figure 2:
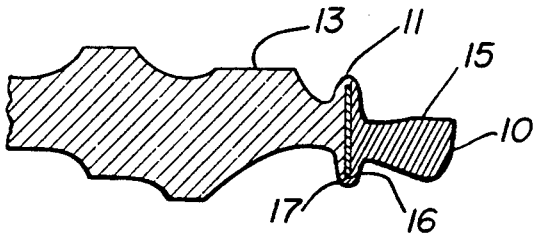
FIG. 2 is a workpiece in which a section has been removed.

FIG. 2 shows a cut-away view of a workpiece and, particularly, shows a section of the sacrificial ribs 11 and 16 which are adjacent the bond line 17. The bond line 17 is, of course, in fact, a surface of revolutions which represents the contact between the bore section 13 and the rim section 15.

Figure 3:
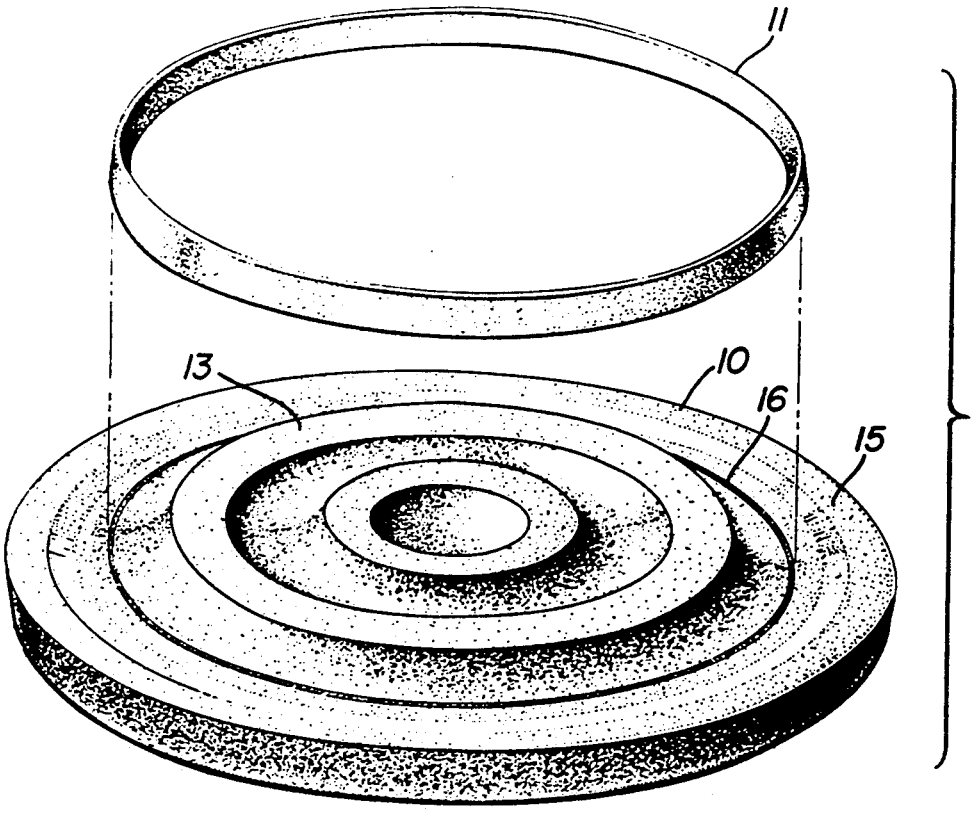
FIG. 3 is a workpiece in which a sacrificial rib has been removed.

In FIG. 3, the disk is shown after the sacrificial rib 11 has been machined away from the disk.

Figure 4:
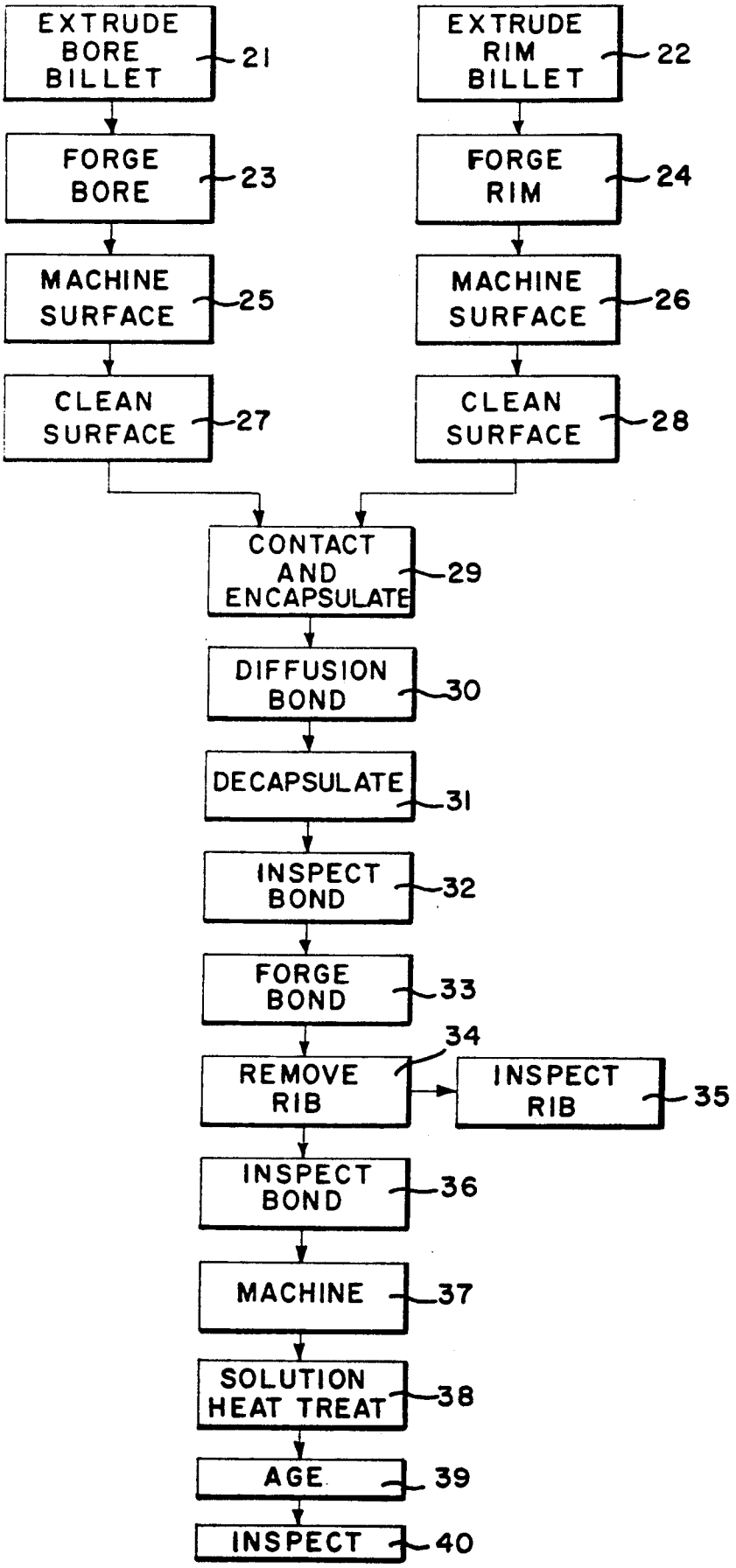
FIG. 4 is a process flow sheet.

FIG. 4 shows a flow chart of a typical application of forge enhanced bonding (mode 2). In steps 21 and 22 respectively, the bore and rim sections would be formed, by extrusion techniques, from powdered metal into a billet. In steps 23 and 24, the bore and rim would be forged into preform shapes. In steps 25 and 26, the parts are machined, and in particular, the mating surfaces are machined so that they are shape conforming to one another as the rim section fits peripherally about the bore section. In steps 27 and 28, the mating surfaces are cleaned, as, for example, by electro-polishing. Although this discussion will focus on bond lines which are parallel to the forge axis and the axis of an axisymmetric workpiece, it should be understood that the designer may elect to give the bond line a draft angle (make it non-parallel to the workpiece axis) for ease of assembly. This will, of course, make the boundary surface a conic section rather than a cylinder.

In step 29, the bore and rim pieces are placed in contact and encapsulated in a rough vacuum environment. This encapsulation can be accomplished by electron-beam welding simply at the outer edges of the bond surface, by electron-beam brazing in the same way, or by encapsulating the entire disk in a can.

In step 30, the two pieces are diffusion bonded by exposing the work piece to hot isostatic pressing.

In step 31, the encapsulation is removed and in step 32, the bond is inspected.

Step 33 is where the work piece is exposed to the forge enhanced bonding which will be discussed in detail subsequently.

In step 34, the sacrificial rib is removed and inspected in step 35.

In step 36, the bond within the workpiece itself is inspected. The workpiece is machined to appropriate shape in step 37.

In step 38, the work piece is solution heat treated.

In step 39, the work piece is aged, and in step 40, the work piece is inspected.

Figure 5:
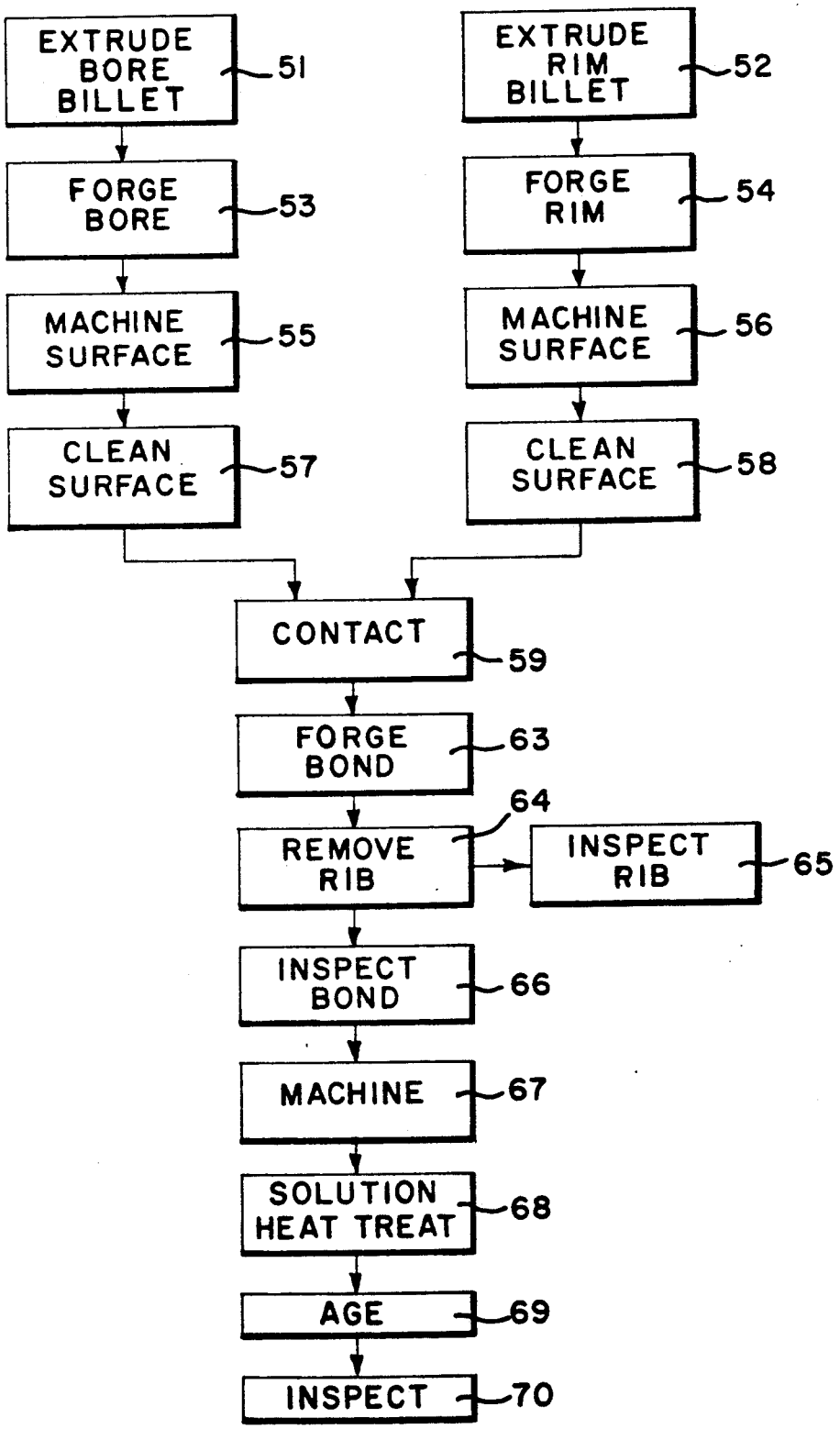
FIG. 5 is a process flow sheet.

FIG. 5 shows a flow sheet for the application of the present invention to forge bonding (mode 1). Essentially the preliminary activities are similar to those shown in FIG. 4 until step 59. In step 59, the bore and rim are placed in contact. At this point, the process may simply continue to the next step of forge bonding This is particularly acceptable where the two pieces are forced-fit together by designing the bond line with an appropriate draft angle or by using thermal expansion and contraction to form a very tight fit. However, it may be necessary, in appropriate circumstances, to tack weld the pieces together or to encapsulate the pieces in order to protect the clean surface from contamination or to maintain an inert atmosphere at the bond surface.

The remainder of the steps are essentially the same as those described in connection with FIG. 4.

FIGS. 6 through 11, demonstrate the steps of an application of the present invention in which vents 85 and 86 are simultaneously positioned at each end of the bond line during the forging process.

FIGS. 12 through 17 show a similar processing sequence in which the venting at one side is done in one strike and then the venting at the other side is done at the other strike. This will be called asymmetric venting as opposed to the symmetric venting of the process in FIGS. 6 through 11.

In FIGS. 6 through 17, it should be understood that the disk, which is shown in cross-section, is made up of a bore and a rim (which appears in two places). The heavy dark line which appears at the bond lines represents potential defects which, as will be seen, are progressively moved out of the body of the work piece and into the sacrificial ribs.

Figure 6:
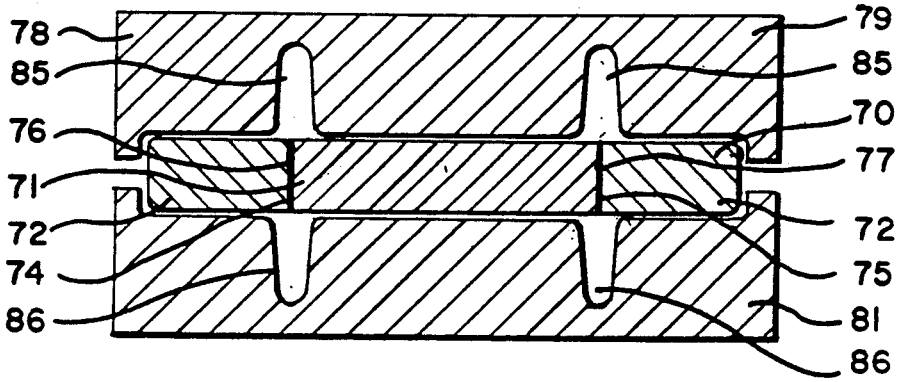
FIGS. 6–17 are diagrammatic views in cross-section of various process steps.

FIG. 6 shows the disk, or workpiece 70, in cross-section through its center, or axis. The workpiece 70 is made up of a central bore or plug 71 and a rim 72, which appears in the drawing in two places. The bore 71 and rim 72 are in contact at a bond surface which is shown in the drawing as bond line 74 and bond line 75. At bond line 74 and bond line 75 are bodies of defects shown as heavy dark lines 76 and 77. The forging die 78 itself is made up of an upper die 79 and a lower die 81. The cavity of both the upper die 79 and the lower die 81 include rib-forming vents 85 and 86 positioned at each of the ends of the bond lines. It should be understood that these vents are, in fact, circular grooves in the face of the die.

FIG. 6 shows the position of the work piece and dies before the forging step.

Figure 7:
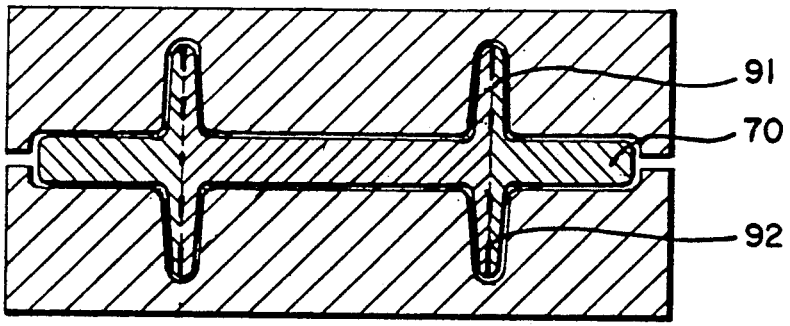

In FIG. 7, the forging step has been carried out and it can be seen that material from the workpiece has been extruded into the vents to form ribs on each side of the work piece. It should be noted that the defect material, shown as dark lines, has been broken up and displaced outwardly from the bond line and into the area of the sacrificial ribs. The dynamic movement of the metal during the forging operation causes very effective displacement of defect material from the area of the bond lines and exposes any defect material left at the original bond line to very high levels of strain It is important to note that the displacement of material at the bound lines is caused by internal stain induced in the metal at the bond line by the forging pressure It is not merely the result of movement of the bore with respect to the rim as the dies close.

Figure 8:
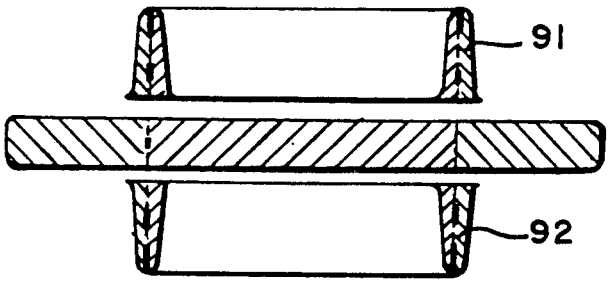

FIG. 8 shows the workpiece after the removal of the sacrificial ribs on each side of the work piece. It can be noted that substantially all of the defect material has been displaced into the sacrificial ribs leaving little or no defect material within the remaining body of the workpiece once the sacrificial ribs have been removed. Because it has been noted that the exposure of defect materials to high strain within the workpiece significantly reduces the deleterious effect of the defect materials on the properties of workpieces, it is often appropriate to accept the very low level of defect material which remains in the work piece at FIG. 8 and continue the processing of the work piece in the conventional way.

In situations in which it is particularly important to minimize the potential presence of defects at the bond lines, it has been found effective to essentially do a restriking of the work piece to carry out the defect displacement again. As will be known to those in the art, the intention to carry out this restriking capability should be considered in designing the die and entire forging process.

Figure 9:
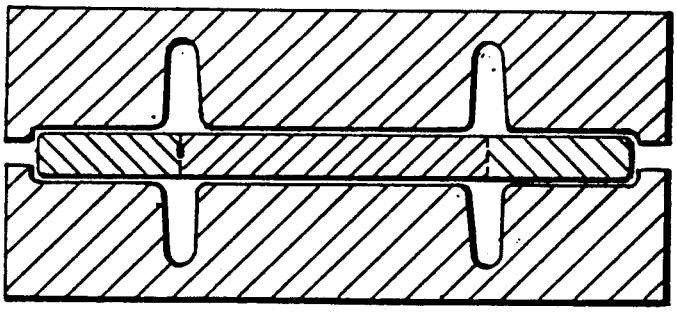
Figure 10:
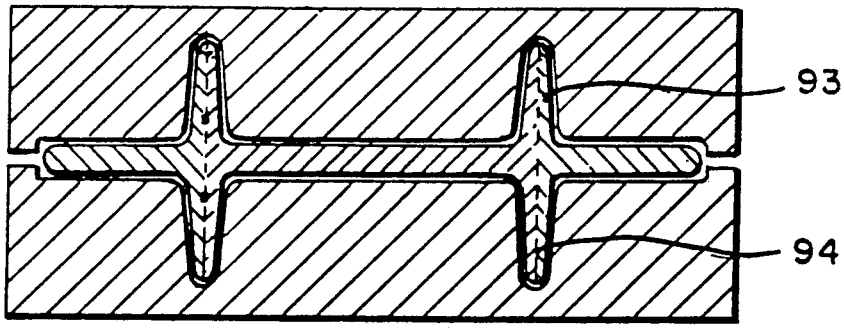
Figure 11:
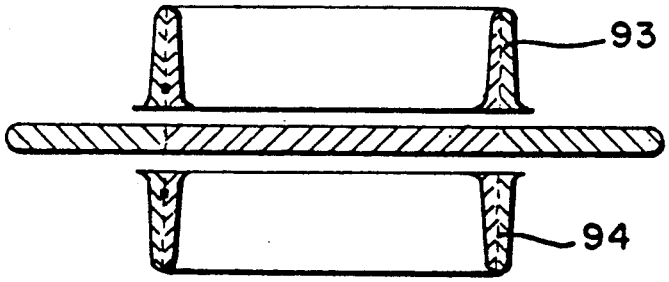

FIGS. 9 through 11 show the sequence of the subsequent forging. As can be seen by noting the location of the dark spots in the work piece, they are displaced outward from the body of the work piece into the sacrificial ribs where they are removed in FIG. 11. Depending on the intentions of the forging engineer, the dies used in the second strike might be the same as those used in the first strike or might be different.

Figure 12:
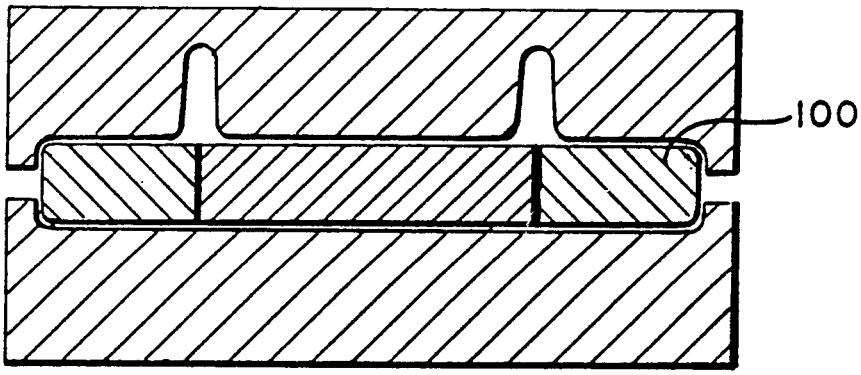

FIGS. 12 through 17 show a process in which the ribs are formed in an asymmetric manner. This technique has been found to be very effective in various circumstances because there is no point along the bond line where the strain reaches an essential equilibrium. As a result, the displacement which occurs at every point along the bond line, at one or the other of the two forging steps, very effectively displaces the defects away from the body of the workpiece. FIG. 12 shows the unprocessed work piece 100 and the other elements which correspond roughly to those shown in FIG. 12. Note, however, that the lower die does not have the rim-forming vents.

Figure 13:
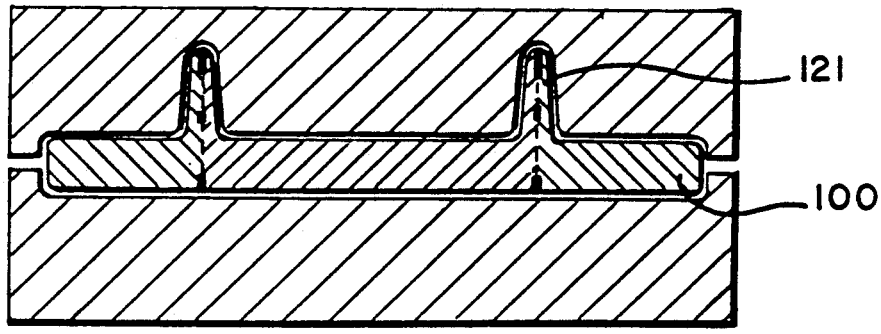

Thus, as shown in FIG. 13, the forging operation causes displacement of material from the area of the bond line upwardly into the vents of the upper die. This very effectively moves the material from approximately the upper two-thirds of the bond line upward into the sacrificial rib area.

Figure 14:
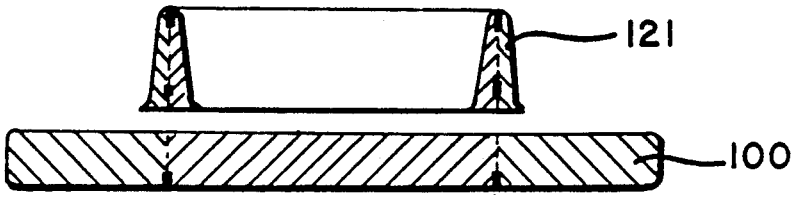

In FIG. 14, the workpiece is shown after removal of the upper sacrificial rib.

Figure 15:
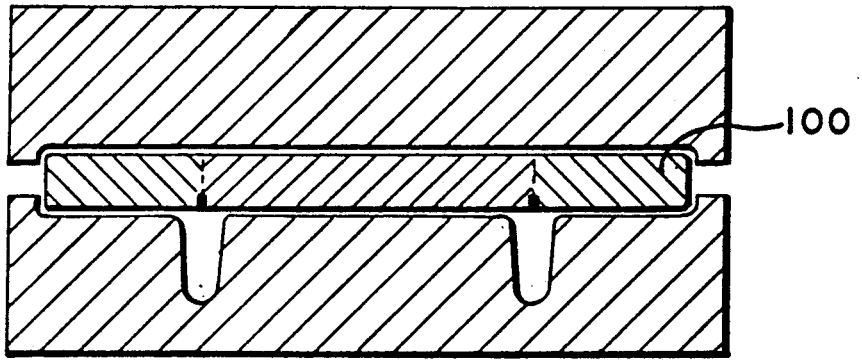

Since the amount of defect material which remains at the lower end of the bond lines in FIG. 14 is probably not acceptable, this embodiment of the invention probably requires the further processing which is shown in FIG. 15. In that case, a new set of dies, in which there is no vent in the upper die, but there is a vent in the lower die, is used.

Figure 16:
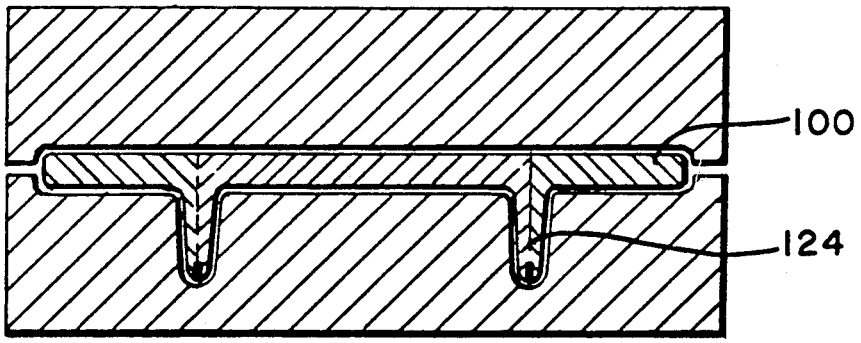

FIG. 16 shows the second forging step in which displacement of the material at the bond line occurs downwardly into the vents in the lower die. This very effectively removes the remaining defects which were at the lower third of the bond line and essentially removes the defects from the main body of the work piece.

Figure 17:
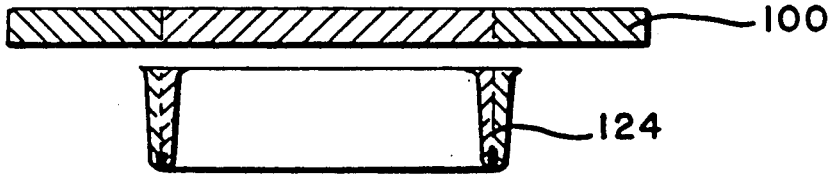

FIG. 17 shows the removal of the lower sacrificial rib and shows that the defects have been effectively removed from the body of the work piece. It should be kept in mind that any of the defects which remain in the body of the work piece have been exposed to very significant strain, thereby, reducing their deleterious effects.

It has been found that this process can shift 99% of the defects which were present at the original bond, out of the final shape or volume and into the sacrificial rib. Typically one strike removes 60–80%, and the second strike removes all but less than 1%. Furthermore, the remaining defects are deformed by 350% or more, thus substantially reducing their contribution to low cycle fatigue failure. The defects in question may include trapped dirt, oxides and voids, metallurgical defects and undesired interface alloys, and carbide precipitates, and gamma prime depleted zones. In essence, new metal from the body of the alloys is presented to the bond line.

The preferred embodiment of the present invention involves a series of process steps for forming a dual-alloy disk suitable to be formed into rotors, such as those used in gas turbine engines. The technical approach is centered on technology best described as "forge bonding" or "enhanced forge bonding". As will be clear from the context, the term "forge bonding" is sometimes alternatively used generically to denominate the forging operation itself which is the focus of both modes. In experiments, the feasibility of this technology for producing a dual-alloy disk with a high integrity bond has been demonstrated.

The concept of forge bonding powdered metal superalloys includes four basic steps:

1. Isothermal forging of bore and rim preforms.
2. HIP diffusion bonding of bore and rim preforms.
3. Isothermal finish forge operations to locally deform the bondline.
4. Heat treating the forge bonded disk to optimize the properties in the bore, rim and across the bondline.

The focus of the forge bond approach is Step #3, the finish forge operation. The purpose of this operation is to highly deform the original bondline and to displace the original bondline material with inherent defects outside of the finish machined part.

Figure 18:
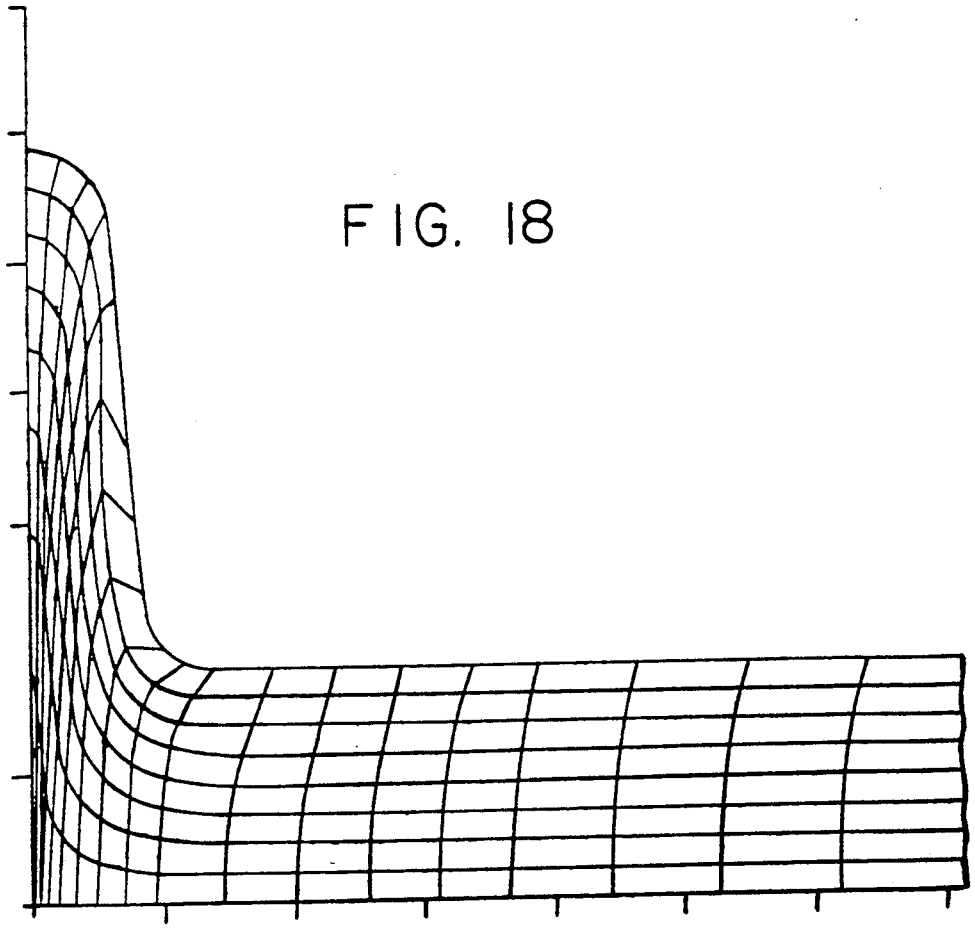
FIG. 18 is a view of a grid pattern after processing.

A schematic of a bonded preform in a set of dies is shown in FIG. 6. The dies are designed such that the deformation in the finish forge operation is concentrated at the bondline. The metal flow in this type of forging is shown in FIG. 18. Prior to forging, an equidistant vertical/horizontal grid was scribed on a preform. The deviations from horizontal show the large strains and displacements realized at the bondline. The translation of the vertical lines shows the flow of new material to the bondline to replace the original bondline interface.

Finite element modeling of bondline displacements in subscale forgings has shown that strains of up to 350% at the bondline and displacements of as much as 98% of the original bondline to a position outside of the finish part can be realized with the cavity geometries tested. These results have been verified by experiments. Larger strains and greater displacements are achievable with different die cavity designs.

The strains and displacements are effective in removing defects from the original bondline. This has been demonstrated in forging of subscale, plane strain coupons. In the extreme, highly oxidized, unbonded interfaces have been dramatically improved by forge bonding. In one test of two Rene' 95 preforms forge bonding caused 200% strain and 85% bondline displacement out of the part final shape Cutting off the top and bottom "ribs" and reforging increases the bondline strain to 350% and the bondline displacement to 98% out of the final shape. The bond line which remained in the final shape was substantially defect free.

Similar results have been demonstrated using unbonded couples of dissimilar alloys. There was a significant improvement in bond cleanliness as a result of forge bonding.

The demonstrated results of forging "dirty" unbonded preforms support the concept of forge bonding. The finish forge operation removes the original bondline interface and associated defects. As the production process is envisioned, preforms will be diffusion bonded prior to the finish forge operation. Prior to the diffusion bond operation, the mating surfaces will be scrupulously cleaned to produce a high integrity bond. Consequently, the forge bond operation will only further improve the bondline properties, especially in fatigue where defect population is so critical. This forge bonding process is ideally suited for use with the demonstrated ability to make a "clean" diffusion bond between dissimilar powder metal superalloys by electropolishing mating surfaces and hot isostatic pressing (HIP).

Besides providing bond strength (from the diffusion bond) and bond cleanliness, the forge bond approach to producing a dual alloy disk also gives exceptional control of the bondline position. The original diffusion bond location can be controlled to machining tolerances (plus or minus 0.002"). Subsequent forging in the finish dies is also a very controllable process since the deformation is concentrated in the area of the bondline, and flow is from both sides of the bondline toward the center. Metal flow is predictable using ALPID modeling. The major influence in translation of a vertical bondline during finish forging is the difference in flow stress between the bonded alloys. If the forge bonding is done with symmetric vents equidistant from the disk axis, even a bond surface with draft angle will predictably become parallel to the axis. On the other hand, if it is desired to maintain or establish a draft angle, the vents in the upper and lower die should be set at different distances from the disk axis, i.e., over the ends of the desired bond line. It has been further found that the cross-sectional shape of the vent effects the straightness of the post-forge bond line. The vent shape can be used to normalize the effect of differing flow characteristics of the two alloys.

As noted, the forge bonding approach to making a dual alloy disk has been demonstrated in subscale forging. The bonds have been forged at realistic temperatures and tonnages. There is no identifiable technical issues that preclude this forge concept from being scaled-up to produce a 25" dia. high pressure turbine disk Critical to the development of a dual alloy disk is heat treatment of the part after forge bonding. The complications are many due to the potential wide variation in the gamma prime solvus of the bonded alloys and the need to supersolvus heat treat. It happens that properties are dependent on cooling rate from the solution temperature, and that powdered metal forged alloys are susceptible to critical grain growth Maximum utilization of this process requires an understanding of heat treat reactions such as grain coarsening, critical grain growth, properties vs. cooling rate, phase stability, and carbide reactions. Development of such understanding can include extensive use of NIKE/TOPAZ (2D) and ANSYS (3D) analytical software for modeling the heat treatment. One critical concern is the avoidance of cracking and distortion during heat treatment. It is also advisable to perform a nonlinear finite element analysis of the part during heat treatment using the elastic-visco-plastic constitutive equations of Bodner-Partom. The damage model incorporated in the VISCRK software is designed to predict inelastic strains including plasticity, creep and stress relaxation which develop during the heat treat cycle.

A high sensitivity has been developed to the importance of heat treat control during the production of monolithic Rene' 88DT forgings. This knowledge in modeling and cooling rate control (fixturing) can be adapted and applied to the dual alloy disk concept.

The maximum potential of the present process will require that the dual alloy forgings be treated by differential heat treatments in solution and ageing. We are developing and have applied for a patent on a differential heat treat approach for disk forgings. The concept, termed Partial Immersion Treatment (PIT), includes the immersion of a segment of the rim section of a disk in a high temperature (molten) salt bath and revolution of the disk to selectively heat treat the rim section while maintaining a lower temperature in the bore. The feasibility of this technique has been demonstrated on both P/M and cast-wrought nickel-base superalloys. One of the critical advantages of PIT is that it allows relatively precise location of the physical boundary of heat treatment on the workpiece. Likewise, the present forge bonding process allows very precise location of the boundary surface between the alloys These facts synergistically allow precise differential treatment in which each alloy gets the exact treatment it needs, without the problem that intermediate zones are exposed to the wrong heat treatment. For example, when the forge bonding process is conducted to cause a bond line with a draft angle, the axis of rotation of PIT can be elected at an angle from the horizontal so that the heat treatment conforms to the angles of the bond line.

Another important part of the dual-alloy turbine disk concept is the need for non-destructive evaluation. This will be critical to the ultimate commercial success of the program.

Regarding non-destructive evaluation, the forge bond concept does provide a unique non-destructive means of "testing" the quality of the bondline. The material that is forged into the cavity (rib) represents over 95% of the original bondline. That material can be removed from the forging as a "test ring", and examined. It will provide a check on the quality of the original diffusion bond based on cleanliness. It will also be a check on the forging of the bondline; the bondline should be present in the rib and in a predictable orientation.

It is sometimes possible in the forge bond approach to "restrike". If the bondline displaced into the cavity is not of the cleanliness required, the part can be forged again, displacing additional bondline into the cavities. This material can again be removed and metallographically examined.

Another potential application of the restrike capability would involve sonic machining and sonic inspection of just the bondline region after forging. Again, if there was a defect, the part could be reforged to remove that bondline defects and reinspected.

For each dual alloy match, it will be important to determine the effect of bondline defects on mechanical properties. Experiments involving purposefully seeded defects will help in the definition of inspection limits and bond cleanliness standards.

Overall, forge bonding is a very promising approach to producing a dual-alloy, high-pressure turbine disk.

The development process for applying the present invention to a new pair of alloys would typically involve three phases:

Phase 1A. Subscale Test Development,

Phase 1B. Subscale forging of Axisymmetric Shapes, and

Phase 2. Full scale studies.

A typical development program is set out below.

Phase 1A: Subscale Test Development (Two Alloy Pairs)

1.1 Billet Procurement 1.1.0 Prepare extruded billet for each of four alloys, at an extrusion ratio 6:1 to yield fine-grain microstructure. Procedures must be carried out to assure predictable high quality. Sonic inspection to monitor quality.

1. One 9¼" dia. extrusion (3500#) per alloy for Phase I and II combined
2. One 6½" dia extrusion (1500#) and one 9¼" 0 extrusion (3500#) per alloy. Powder should come from the same powder lot.

1.1.1. Isothermally forge three mults per alloy on flat dies. Alloys are preferably forged superplastically to maintain fine grain size. Forged material will be used for test coupons.

1.2 Compression Tests 1.2.1 We recognize the importance of flow data for effective analytical modeling. We propose to obtain data at seven (7) temperatures and at five (5) strain rates for a total of thirty-five (35) tests per alloy. Both subsolvus and supersolvus temperatures will be studied. Due to the nature of the forge bond process, data at a strain rate of 0.0001/sec. will be generated. Each test specimen shall be characterized for grain size.

1.2.2 A metallographic grain coarsening study will be performed to determine grain size as a function of thermal exposure temperature. This information will be used in deciding upon an optimum forge temperature. Eight specimens per alloy will be exposed at 10° F. increments.

1.3 Preform Preparation

The baseline preform preparation technique will be to surface grind the mating surfaces to a fine finish (64 RMS) and electropolish prior to joint sealing and bonding. However, there are sometimes alternatives for both surface preparation and sealing.

1.3.1 The surface preparation techniques that will be studies include:

1. Electropolishing (4 conditions per alloy)
2. Chemical cleaning (4 solutions per alloy)

Emphasis will be placed on evaluating the reaction product of these cleaning techniques on the specimen surfaces after exposure to air. Plasma cleaning is an option.

1.3.2 The development of a reliable joint sealing technique will be of high priority at the onset of the program. Although the Electron Beam/Braze Wire combination has been used, there are still problems with cracking at the joint in some cases. Three methods appear practical:

Electron Beam welding
Braze sealing (direct or with cover plate)
Canning
Canning perhaps has the lowest risk, but it involves more operations than do the others. As a result, some alternative to canning will be sought where practical.

It is proposed that eight trials/per alloy couple be performed with each of the electron beam welding and braze sealing techniques. Two canning techniques per alloy couple will be tried.

The study will involve HIP bonding and subsequent metallographic examination of the joint. The evaluation criteria will include propensity for cracking, depth of penetration of the "seal weld", control of penetration depth, contamination of the mating surfaces, repeatability, and ease of manufacture.

1.4 Bonding

Our approach to bonding includes two major operations. Isothermally forged powder metal preforms are first HIP (Hot Isostatic Pressing) diffusion bonded to establish a high integrity bond with no degradation in strength or stress rupture properties compared to the basemetal alloys. This is followed by another isothermal forge operation (finish forge) where the bondline is locally deformed such as to:

A. Minimize strain
B. Displace the original bondline outside of the finish machined shape.

The major purpose of this finish forge operation is to eliminate bondline defects that could degrade cyclic properties.

1.4.1 The diffusion bond will be created in a HIP cycle. A matrix experiment will be performed to establish the proper HIP/diffusion bond conditions. The objective will be to create a high integrity diffusion bond without adversely effecting the fine grain microstructure of the alloys. As a result, the HIP temperature will be subsolvus for all alloy combinations.

A series of 8 specimens will be used per alloy pair.

The specimens will be electropolished and sealed prior to HIPing. Initially, bonding will be evaluated metallographically and by R.T. tensile testing (with supersolvus H.T.). Subsequently, additional tensile and S/R tests will be performed on specimens given the most promising HIP cycle. The purpose will be to demonstrate the high integrity of the as-bonded specimens, i.e., the bondline tensile and S/R properties are not below the lesser of the base metal alloys.

1.4.2 Finish Forge Development

We have demonstrated in subscale forging that the forge bond concept is effective, i.e., large strains and displacements at the bondline can be achieved. Experiments will be performed, however, to optimize the metal flow and investigate changes that would ease manufacturability.

We will use the plane strain specimen in all Phase IA forging studies. This specimen was developed during the past year and its effectiveness has been proven. Subscale axisymmetric forgings will be made in Phase IB to further substantiate the results. A test plan for Phase IA involving the following variables is shown in Table III:

A. Cavity shape
B. Cavity system (Top/Bottom, Bottom)
C. Forge temperature
D. Forge strain rate
E. Bondline angle (draft angle)

Specimens will be forged on a 200 ton Isothermal Press. The maximum forge temperature for these subscale experiments will be based on results of the compression tests (flow stress, strain rate sensitivity) and a parallel metallographic grain coarsening study (1.22). The objective is to remain in the superplastic forge regime (fine grain size). This will increase forgeability and reduce the potential for subsequent critical grain growth in heat treatment.

In addition to evaluating bondline strains and displacements, other pertinent criteria include die fill, forging loads and forging time. Specimens will also be metallographically examined to check bondline microstructures.

At present, the forge bonding of coarse grain preforms (although possible) does not seem practical. Supersolvus forging will probably result in too coarse a grain structure. Subsolvus forging of coarsened preforms may produce too dramatic a change in grain size at the bondline. However, two experiments have been included for each alloy couple (Task 5, forge temperature). We will investigate supersolvus forging of fine grain, bonded coupons and subsolvus forging of previously coarsened preforms.

1.5 Process Modeling

Deformation modeling will be used extensively to support the forging experiments. The modeling of the forging process will be carried out using ALPID, a rigid-viscoplastic code that allows for isothermal or non-isothermal simulation of forming processes with arbitrarily shaped dies. We have demonstrated the applicability of ALPID in accurately modeling the forge bond process. The ALPID results are particularly good in predicting vertical displacements of the bondline.

Each die change and forging condition will first be modeled with ALPID to insure that the choice of parameters is optimum.

1.6 Product Forgings

We will forge bond sufficient plane strain specimens for use in the heat treat, NDE and bondline characterization tasks.

| | |
|---|---|
| Heat treat (1.7) | 22 specimens |

-continued

| | |
|---|---|
| NDE (1.8) | 28 specimens |
| Characterization | 10 specimens |

The concentration of our effort will be on heat treating fine grain—fine grain forged bonded specimens. Of course, if the forge bonding of coarse grain preforms shows merit in subscale forging experiments, we will change the focus of the heat treat development.

1.7.1 The initial experiments focus on developing monolithic heat treating procedures for the dual alloy disk. Creep-rupture and tensile properties will be generated for each alloy as a function of cooling rate. Eight conditions each will be tested for the four alloys.

1.7.2 Based on the results of the above (1.7.1), forge bonded coupons of each alloy pair will be heat treated using four different conditions. Tensile and creep rupture properties will be determined for the base metal and across the bondline.

1.7.3 In a parallel effort, data will be generated using the partial immersion heat treat (PIT). This concept utilizes the partial immersion of a forging in a salt bath to achieve selective heat treating. The test matrix will involve forge bonded preforms to experimentally determine the range of microstructure that can be developed in the vicinity of the bondline by a partial immersion in a salt bath.

Bonded coupon specimens will first be given a monolithic heat treatment at T1 (Bore solvus+40° F.) and control cooled. The specimens will then be partially immersed (rim alloy submerged) to varying positions at/near the bondline. Metallographic examination will be used to determine the microstructures derived by overlapping heat treatments. Tensile tests will follow where appropriate to determine the effect on strength.

1.7.4 A 3-D finite element code, ANSYS, will be used to model the heat treatment. We also propose to use a code which includes the Bodner-Partom equations for inelastic deformation including creep damage. To effectively utilize these codes, we will generate the following data for each alloy:

A. Specific heat
B. Thermal conductivity
C. Emmisivity
D. On-cooling tensile data

1.8 NDI (NON-DESTRUCTIVE INSPECTION) TECHNIQUES

We realize the critical aspect of NDI in the successful commercial implementation of a dual alloy disk.

As noted in the introduction, the forge bond concept does provide a unique NDI advantage in that the bondline material forged into the die cavity (rib) can be inspected to verify initial HIP bond cleanliness and forging control. This ability to examine bondline interface will also permit restrikes.

In this phase of the program, the consequences of a "dirty" bond on mechanical properties will be determined. This will be valuable information in setting "process window" for the HIP bonding process.

We will purposefully fabricate bonded plane strain specimens with "dirty" bondlines. Specimens will either be purposefully contaminated during the HIP cycle, or "seeded" with defects (alumina etc.) at the bondline and subsequently HIP diffusion bonded. Specimens will be non-destructively inspected to establish detection limits, and subsequently finish forged. Forgings will be evaluated metallographically in the forged "ribs" and along the bondline. Tensile and LCF testing will be performed across the bondlines (after heat treat) to determine the degradation in properties with defect density.

1.9 We will accomplish the evaluation of forge bonded coupon specimens.

1.9.1 Once the forge bond development study (1.4) and the heat treat development program (1.7) are complete, we will test a candidate forge bond couple (heat treated) and select the most sensitive test technique. Testing will be limited to tensile and stress rupture at varying temperatures.

1.9.2 We will characterize the bondline microstructures using optical microscopy and SEM.

1.9.3 We will selectively test up to 6 promising forge bonded couples (3 per alloy pair). We will perform duplicate testing. However, creep-rupture conditions should be picked to result in 100 hour life (not 500 hour lives) so as to expedite results.

Subscale specimens will be used for this study. As a result, fatigue crack growth coupons must be limited to 4"×1"×0.375".

1.9.4 We will perform additional testing.

1.9.5 We agree to provide the customer with forging remnants and microslices.

Phase 1B: Subscale Forging of Axisymmetric Shapes.

We will use the plane strain coupon specimens in Phase 1A. This geometry has been shown to be well suited for development of forge bonding conditions. As a means of validating the plane strain results prior to full-scale development, we will forge bond subscale axisymmetric parts. These forgings will be of the same shape as the full scale forgings. The diameter, however, will be limited to approximately 4.25" dia., and the shape will be scaled proportionately We will forge 10 bore/rim bonded preforms in the axisymmetric dies. Two cavity shapes will be used. The bonds will be evaluated based on metallographic examination. The flow will be evaluated by forging grids as in FIG. 17. Mechanical property testing will not be practical based on the size of the forging and placement of the bondline.

We have substantial experience in using subscale forgings to validate designs of full scale production isothermal forgings. Subscale forgings are particularly effective in simulating metal flow which is the key in the forge bond operation.

Phase 1A and 1B Tooling and Fixturing

1. Plane strain die set for the 200 ton isothermal presses. This is to allow greater flexibility in specimen size and forge bond cavity size.
2. Four sets of knock outs with different forge bond cavity geometries.
3. Die set for axisymmetric forge bond study. Resinking of the dies (3X).

Phase 2: Full Scale Studies on Two Alloy Pairs.

We believe that the forge bond approach to making a dual alloy disk can be successfully scaled-up to produce a 25" dia. high pressure turbine disk. An advantage of forge bonding is that it relies on isothermal forging which can be physically modeled in subscale. ALPID deformation modeling is also particularly effective in isothermal forging situations.

We will procure 9¼ dia. extruded billet for the four alloys chosen. These alloys compositions are assumed to be the same as used in Phase I, Subscale Development.

The extrusions will be formed using processes that assure high quality.

2.2 Seven preforms for each alloy pair will be fabricated (28 total). Bore preforms will be forged from 9¼ dia. extruded billet in two operations. The bore preform will be forged out just beyond the bondline diameter. Rim preforms will have to be made as a pancake forging and subsequently machined.

2.3.1 Preforms will be machined to shape and mating surfaces prepared for bonding. The bore and rim preforms will be fitted together, sealed and HIP diffusion bonded. Presently, the plan is to HIP diffusion bond one disk preform (bore and rim) in a HIP run (14 HIP cycles). The first diffusion bonded disk for each alloy pair will be heat treated and destructively tested. This is to demonstrate that HIP diffusion bonding produces a high integrity bond with required tensile and creep rupture properties. The LCF results will be used as a baseline to compare forge bonded LCF (Low Cycle Fatigue) properties.

2.3.2 We propose to forge one monolithic superalloy part in the forge bond dies prior to committing a dual alloy HIP bonded preform. This would be done to test out the die geometry. This part would then be available for use as an instrumented disk in heat treat trials.

2.3.3 The forge bond approach has a unique capability which can be used in development. Because of the constrained nature of the metal flow, bonded preforms can be sectioned radially prior to the finish forge operation. The pie shaped piece can be examined, scribed with a grid, and then replaced without seriously effecting the flow in the majority of the forging during the forge bond operation. After forging, the grid pattern can be examined to positively show the strains and displacements at the bondline, as per the subscale forging in FIG. 17.

A variation of this idea can also be applied. A section of the HIP bonded preform can be removed and destructively tested to evaluate the bondline quality/reproducibility. This cut-up section can be replaced by an equal section from another "sacrificial" preform, probably the remnants of another sample. This provides a low cost method of bondline quality verification in the early development phase (cut-ups). The forgings will be made in Task 2.8.

2.4 Modeling Data

The flow and heat transfer data generated in Phase I will be used where appropriate. If the alloy chemistries change, the flow data and heat treat data will have to be generated as described in the Phase I summary.

2.5 Forge Modeling

The ALPID deformation software will be used to extensively model the metal flow in finish forge operation. ALPID will be used to define the proper cavity shape and dimensions in order to achieve the desired strain and displacement fields.

We will also use software incorporating the Bodner-Partom damage law for analyzing the die stresses prior to forge bonding.

2.6 Heat Treat Modeling

We will use finite element 3-D codes to model the proposed heat treatments for the dual alloy disk. The codes will predict internal stresses and distortions generated during 15,000 quenching. The analytical results will be compared to results experimentally generated using a thermocouples forging of the same shape. Finite element software incorporating the Bodner-Partom equations with damage will be used to predict creep damage at the bondline during heat treatment.

2.7 Tooling/Fixtures

We propose to modify existing tooling designed for a typical turbine disk.

2.7.1 Resink existing dies to modified design. Changes will be based on ALPID results for optimum preform design going into finish forge dies.

2.7.2 Sink forge bond cavities (vents) at bondline in dies. Modify dies cavities 4 times.

2.7.3 Fabricate heat treat rack to produce control cooling of dual alloy disk after solution heat treat in Rotary Furnace.

2.7.4 Modify partial immersion heat treat hardware to accommodate 450# forging (new motor and drive shaft).

2.7.5 Fabricate fully instrumented test forging for heat treat studies. This high performance turbine disk forging will have been made from a superalloy.

2.8 Produce High Performance Turbine Disk Forgings 2.8.1 HIP bonded preforms will be machined to remove the seal weld (can) and will be finish forged in the 8000 ton Clearing Press. The die configuration, forge temperature and forge rate will all have been determined via ALPID modeling and subscale forging.

Finish forgings will be made in separate set-ups so that the knowledge gained from each forging can be applied to the next. If the forgings have been sectioned previously (for grid or evaluation of the bondline), they will have to be cold loaded in the dies and heated to temperature along with the dies. HIP bonded preforms not sectioned previously will be heated in the attached rotary furnace under vacuum, and transferred to the press via standard production transfer operations.

A total of 6 high performance turbine disks per alloy couple will be forge bonded 2.8.2 An advantage to the forge bond approach is that bonded preforms can be restruck several times. All that is needed is to machine-off the forged ribs and recoat. This may be of great utility in the early stages of the forge bond phase. The first disk forge bonded can be used until any die problems have been eliminated. If the modeling is amiss in predicting forging loads or lubrication behavior, the problem can be corrected with a die change and that same part can be reforged (even after examination of one section).

2.9 Heat Treatment of Forgings

We will apply the knowledge gained in the Phase I study to optimally heat treat the full scale forgings. Analytical modeling of the process along with full scale instrumented trials should lead to success. We will work to insure that the partial immersion heating equipment is ready if required.

Forgings will be heat treated individually. We are estimating that 6 forgings can be heat treated in conventional furnaces and 6 forgings will require salt bath heat treatments.

2.10 Non-Destructive Evaluation

There are certain characteristics of the forge bond approach that aid non-destructive evaluation. As described in Phase I, a major advantage of forge bonding is that a high percentage of the original bondline is displaced (forged) outside of the part. The material in the ribs can be metallographically examined as in the subscale forgings (Phase I). However, on full-scale forgings, the rib (ring) may be large enough to be removed from the part and sonicly inspected. An example is shown in FIG. 3. There should be 0.060–0.100" cover from the outside surface of the rib to the bondline. This should permit high sensitivity sonic inspection of the rib. Other inspection methods may also be available given this type of flexibility.

2.11 Preliminary Evaluation of Forgings

Testing of each disk will be performed in accordance with appropriate standards.

2.12 Detailed Evaluation of Forgings

Detailed testing of bore, rim and bondline regions of two selected disks will be performed in accordance with appropriate standards.

2.13 Process Evaluation

We will review all data in order to select the optimum forge bond conditions for production.

While it will be apparent that the illustrated embodiments of the invention herein disclosed are calculated adequately to fulfill the objects and advantages primarily stated, it is to be understood that the invention is susceptible to variation, modification, and change within the spirit and scope of the subjoined claims.

The invention having been thus described, what is claimed as new and desired to secure by Letters Patent is:

1. A method of forming a disk having a disk axis, a first disk face and a second disk face and an annular outer edge which defines the outermost extent of the workpiece, the disk having a central portion formed of a first alloy and an annular peripheral portion formed of a second alloy, and the boundary between the central and peripheral portion being a surface of revolution about the disk axis and being defined by a generatrix having a first end and a second end, a line between the first end and the second end forming a bondline, said surface having a first circular edge at the first face of the disk and generated by the first end of the generatrix, and a second circular edge at the second face of the disk and generated by the second end of the generatrix, and the disk also comprising material initially present at the boundary, comprising the steps of:

(a) placing the disk between a first die having a first die face and a second die having a second die face at least one of said dies having an annular vent formed in its die face, said vent having two concentric vent edges at the die face and said vent having a cross-sectional profile in a plane radial to the disk axis and a height line which is a line representing the distance between a base line on the cross-sectional profile and which connects the vent edges, and a point on the cross-sectional profile and on the vent farthest from the base line, (b) causing the dies to approach one another along a forging axis which is parallel to the disk axis so that the vent edges straddle a circular line on a face of the disk, said circular line being the desired location of one of the circular edges of the surface, and thereby to cause some of the first alloy and some of the second alloy, along with a substantial amount of the material that was present at the boundary, to flow into the vent along a line of movement substantially parallel to the forging axis to form a rib in the vent, and (c) removing the rib from the disk.

2. A method as recited in claim 1, wherein the said substantial amount is at least 80% of the material initially present at the boundary.

3. A method as recited in claim 1, wherein the said substantial amount is at least 90% of the material initially present at the boundary.

4. A method as recited in claim 1, wherein the said substantial amount is a least 95% of the material initially present at the boundary.

5. A method as recited in claim 1, wherein the said substantial amount is at least 99% of the material initially present at the boundary.

6. A method as recited in claim 1, wherein at least one of the alloys is a superalloy.

7. A method as recited in claim 1, wherein the first and second alloy are superalloys.

8. A method as recited in claim 1, wherein the disk is a gas turbine disk.

9. A method as recited in claim 1, wherein the generatrix is a curved line.

10. A method as recited in claim 1, wherein the generatrix is a straight line.

11. A method as recited in claim 10, wherein, before the method, the generatrix is parallel to the disk axis and, after the method, the generatrix is parallel to the disk axis.

12. A method as recited in claim 10, wherein, before the method, the generatrix is parallel to the disk axis and, after the method, the generatrix has a draft angle with respect to the disk axis.

13. A method as recited in claim 10, wherein, before the method, the generatrix has a draft angle with respect to the disk axis, after the method, the generatrix is parallel to the disk axis.

14. A method as recited in claim 10, wherein, before the method, the generatrix has a draft angle with respect to the disk axis and, after the method, the generatrix has a draft angle with respect to the disk axis.

15. A method as recited in claim 1, wherein the distance between every point on the surface of revolution and the disk axis is less than the distance between the outer edge of the disk and the disk axis.

16. A method as recited in claim 1, wherein the vent is present in only one of the die faces.

17. A method as recited in claim 16, wherein after step c, the workpiece is inverted and the method steps are repeated.

18. A method as recited in claim 16, wherein, after step c, the workpiece is placed in an second pair of forging dies in which the vent is in the other die face and the method is repeated.

19. A method as recited in claim 1, wherein the first die face is provided with a first vent and the second die face is provided with a second vent.

20. A method as recited in claim 19, wherein the first vent and second vent are equidistant from the disk axis during the method.

21. A method as recited in claim 20, wherein the cross-sectional profile of the vents are symmetric about the height line.

22. A method as recited in claim 20, wherein the cross-sectional profile of the vents are asymmetric about the height line.

23. A method as recited in claim 19, wherein the first and second vents are different distances from the disk axis during the method.

24. A method as recited in claim 23, wherein the cross-sectional profile of the vents are symmetric about the height line.

25. A method as recited in claim 23, wherein the cross-sectional profile of the vents are asymmetric about the height line.

26. A method as recited in claim 1, wherein the method is carried out so that the workpiece deforms with enhanced plasticity.

27. A method as recited in claim 26, wherein the workpiece deforms subsuperplastically.

28. A method as recited in claim 26, wherein the workpiece deforms superplastically.

29. A method as recited in claim 1, wherein the method is carried out with the entire workpiece at approximately the same elevated temperature.

30. A method as recited in claim 1, wherein the method is carried out with the dies and the entire workpiece at approximately the same elevated temperature.

31. A method as recited in claim 1, wherein the method is carried out with the dies and the entire workpiece at approximately the same elevated temperature and in such a way that workpiece grain growth is suppressed.

32. A method as recited in claim 1, wherein substantially all of the material originally present at the bondline is caused to move into the vent.

33. A method as recited in claim 1, wherein the method is carried out in such a way as to cause bulk flow within substantially the entire workpiece.

34. A method as recited in claim 1, wherein the cross-sectional vent area is equal to or greater than the width of the mouth of the vent times the initial length of the bondline.

35. A method as recited in claim 1, wherein the cross-section of the vent is substantially triangular with a base side against the workpiece, the width of the mouth of the vent being the length of the base side, and the height of the vent being the length of a height line which is a line representing the distance between the base side and the vent point farthest from the base side.

36. A method as recited in claim 35, wherein the cross-section is symmetric on both sides of the height line.

37. A method as recited in claim 35, wherein the portion of the base side on one side of the height line is greater than the portion on the other side.

38. A method as recited in claim 1, wherein the height of the cross-section of the vent is equal to or greater than the width of the mouth of the cross-section.

39. A method as recited in claim 1, wherein the height of the cross-section of the vent is at least twice the width of the mouth of the cross-section.

40. A method as recited in claim 1, wherein the total cross-sectional area of the vents employed in the method equals approximately the average mouth width of all of the vents employed in the method times the initial thickness of the disk.

41. A method as recited in claim 1, wherein no part of the rib extends farther from the disk axis than does the outer edge.

42. A method as recited in claim 1, wherein, during step b, the edges of the vent are all closer to the disk axis than the outer edge of the disk.

43. A method as recited in claim 1, wherein, each die face is provided with a forging impression which includes the vents, and, except for the vents, the shapes of the impressions of the forging dies define a cavity which closely conforms to the initial shape of the workpiece.

44. A method as recited in claim 1, wherein, each die face is provided with a forging impression which includes the vents, and, except for the vents, the shapes of the impressions of the forging dies define a cavity which closely conforms to the initial shape of the workpiece, so that, except for the ribs at the vents, there is little change in the shape of the workpiece during the process and the displacements and strains in the workpiece are concentrated along the boundary as metal at and adjacent the boundary flows into the vents.

45. A method as recited in claim 1, wherein, following step c, the process is repeated on the bondline that results from the previous application of the process.

46. A method as recited in claim 1, wherein the said substantial amount is substantially all of the material initially present at the boundary.

* * * * *